US005224367A

United States Patent [19]

Ahrweiler et al.

[11] Patent Number: 5,224,367

[45] Date of Patent: Jul. 6, 1993

[54] METHOD FOR THE TREATMENT OF THE STEEL BELTS OF A DOUBLE BELT PRESS

[75] Inventors: Karl-Heinz Ahrweiler, Willich; Bernd Heimes, Mönchengladbach, both of Fed. Rep. of Germany

[73] Assignee: Eduard Küsters Maschinenfabrik GmbH & Co KG, Krefeld, Fed. Rep. of Germany

[21] Appl. No.: 840,485

[22] Filed: Feb. 24, 1992

[30] Foreign Application Priority Data

Feb. 22, 1991 [DE] Fed. Rep. of Germany ..... 4105615

[51] Int. Cl.[5] ..... B21J 1/02

[52] U.S. Cl. ..... 72/53; 29/90.1; 425/371

[58] Field of Search ..... 72/53; 29/90.1; 51/319, 51/320; 425/371

[56] References Cited

U.S. PATENT DOCUMENTS

| | | | |
|---|---|---|---|
| 2,701,408 | 2/1955 | Borger | 72/53 |
| 3,000,425 | 9/1961 | Hodges et al. | 72/53 |
| 3,926,542 | 12/1975 | Ahrweiler | 425/174 |
| 4,213,748 | 7/1980 | Ahrweiler | 425/371 |

FOREIGN PATENT DOCUMENTS

| | | | |
|---|---|---|---|
| 0474625 | 3/1992 | European Pat. Off. . | |
| 2243465 | 11/1979 | Fed. Rep. of Germany . | |
| 2906509 | 8/1980 | Fed. Rep. of Germany . | |
| 3213896 | 10/1983 | Fed. Rep. of Germany . | |
| 2819943 | 12/1984 | Fed. Rep. of Germany . | |
| 3704940 | 1/1989 | Fed. Rep. of Germany . | |
| 3096258 | 4/1988 | Japan | 72/53 |

OTHER PUBLICATIONS

Metalloberfläche, Karl Hanser Verlag, vol. 35 (1981) No. 7, J. Horowitz: Das Shot-peenen von Federn, pp. 251-262.

*Primary Examiner*—David Jones
*Attorney, Agent, or Firm*—Kenyon & Kenyon

[57] ABSTRACT

In a double belt press, in which the steel belts are supported on the back by rollers, inherent compressive stress occurs on the side of the steel belts of a double belt press that are supported on the back by rollers, resulting in an undesirable bowl-shaped deformation of the steel belts. In order to avoid this deformation, at least the side of the steel belts which faces away from the rollers is subjected to treatment by shot blasting before being installed in the double belt press.

4 Claims, 3 Drawing Sheets

METHOD FOR THE TREATMENT OF THE STEEL BELTS OF A DOUBLE BELT PRESS

DETAILED DESCRIPTION

The present invention relates generally to a method for treating steel belts and more particularly to a method for treating steel belts of a double belt press.

Double belt presses of the above-mentioned type are disclosed in DE Patent Nos. 22 43 465, 28 19 943 and 37 04 940. These three references relate to thermal stresses caused by temperature differentials between the center and the edges of the steel belts, which produce a bowl-shaped deformation, particularly on the top side of the lower molding belt on which the dispersed material forming particle board is applied. The deformation of the steel belt significantly impairs the uniformity of the dispersion and the deviation from its horizontal alignment which accompanies this deformation. In addition, due to the different temperatures, additional tension occurs in the molding belts which is superimposed on the applied tension stresses and the bending stresses occurring at the deflection drums, reducing the useful lifetime of the steel belts. To reduce the thermal stresses, DE Patent No. 22 43 465 discloses the step of providing additional heat to the edges of the steel belts which project laterally beyond the roller area and the dumping area. DE Patent No. 28 19 943 provides for corrugation of the steel belt edges, which results in a certain resilience. In DE patent 37 04 940, an edge material free of binder is allowed to run along the edge of the belt, thus maintaining the steel belts in contact with the rollers at the edge area and also ensuring good heat transfer at that location, thus producing a uniform temperature perpendicular to the steel belts.

During the operation of the double belt presses of the type discussed above, there is another phenomenon, in addition to the tendency to produce thermal stresses, which is independent of the temperature but which also gives rise to undesirable tensions and deformations of the steel belts. It turns out that due to the constant movement of the plurality of rollers which transfer their force to one side of the steel belts in limited, almost linear regions while under high surface pressure, a certain plastic deformation coupled with compression of the surface occurs over a long period of time, which in turn leads to compressive stress in the steel belts in a direction perpendicular to their longitudinal axes. Since this compressive stress occurs on only one side of the steel belt, resulting in a state of tension that is therefore asymmetrical over the thickness of the steel belt, the compressive stress also produces a bowl-shaped deformation in the steel belts. This deformation is undesirable because of the increase in stresses produced at the deflection drums and the resulting disturbance of the bulk material as already described, with the latter, in particular, occurring in connection with the lower steel belt, on which are applied the glue-coated chips that form the layer which yield the particle board, in front of the actual pressing segment. Of course, the layer must be as uniform as possible over the width of the strip.

It is known to attach an additional unit to a double belt press of the above-mentioned type which counteracts any undesirable deformations that have occurred during operation, by exposing to shot blasting the lower steel belt, thus compressing the surface in a manner similar to the effect caused by the rollers, but on the opposite side of the belt.

However, a disadvantage of this arrangement is that the steel belts must first undergo the undesirable deformation before the treatment begins. In addition, the treatment requires an extended interruption in the operation of the press, which produces significant economic losses for production systems of this size. Finally, in practice, it is extremely difficult to prevent one of the shot particles from the shot blasting device installed in the double belt press from getting caught between the rollers. Even just one shot particle may cause damage in the area of movement of the rollers, resulting in the press being shut-down and significant repair expenditures.

Therefore, the problem in the prior art is that there is no way to treat the steel belts in such a manner that deformations of the press do not occur without interruptions in the operation of the press or other complications.

SUMMARY OF THE INVENTION

The present invention provides a method for treating steel belts of a double belt press that exert pressure on a continuous strip for producing materials such as particle board. The materials are produced by passing the strip between the steel belts that form continuous loops such that the steel belts extend over the width of the strip and convey the strip in a forward direction. The double belt press also includes rollers rotatable in a longitudinal plane that extends perpendicular to the continuous strip, and a support construction forming pressure transfer elements that transfer the working pressure from the support construction to the steel belts. The rollers are disposed between the steel belts and the support construction. The method includes the step of surface treating at least the lower steel belt on at least a side thereof facing away from the rollers, whereby inherent compressive stress is provided in a region close to the surface of the lower steel belt facing away from the rollers. The surface treating step is performed before the lower steel belt is installed in the double belt press.

The essential idea of the invention is that the compression treatment of the steel belt surface is performed before the belt is installed in the press. In other words, an undesirable deformation of the press does not first have to become evident, and the press also does not have to be shut down, in order to counteract the deformation.

The inherent compressive stress generated in advance on the side facing away from the rollers equalizes the inherent compressive stress generated on the side facing the rollers during operation. A prerequisite for this, however, is that the inherent compressive stress does not constantly increase due to local deformation of the steel belt surface, but rather that their formation comes to a stop. This requirement is met for the steels which may be used to form the belts because of their inherent capacity to compress under plastic deformation.

According to the invention, the treatment which takes place before startup may be performed on only the side of the steel belt facing away from the rollers or it may take place on both sides of the belt at the same time. If the pretreatment is carried out on only one side, the steel belt is first bent in a direction opposite to the undesirable deformation, but after a short time has passed during which the press is in operation, the inherent compressive stress which results on the side of the belt facing the rollers, a uniform stress state begins to form, which comes to a stop after some time, where the stress distribution is approximately symmetrical and the belt is essentially flat when in a state free from external forces. When both sides of the belt are pretreated, the inherent stress state produced in this manner is symmetrical right from the start, and thus the steel belt is installed in the double belt press in a flat state. Because the inherent stress formation has been anticipated ahead of time, and now comes to a stop, no changes which result in deformation occur when the operation of the press begins.

For production of the inherent stress profile according to the invention, any suitable methods may be used in principle, such as thermal methods in which surface transformations are produced by means of a plasma or by means of laser or electron radiation, accompanied by an increase in the specific volume.

In one particular embodiment, however, the inherent stress profile is produced by shot blasting.

In this method, small steel balls are shot at high speed in an air jet perpendicular to the steel belt surface and essentially hammer against this surface, causing the elasticity limit to be locally exceeded, due to the very high surface pressure at the impact points, thus resulting in deformations which lead to the compression of the surface and thus forming inherent compressive stresses.

The hammering and compressing effect is of foremost significance here, as opposed to wear, such as occurs in blasting with sharp-edge, very hard particles, such as during sand-blasting. This is also the reason for the use of balls, which have an overall convex shape that is not suitable for cutting and wear.

DETAILED DESCRIPTION

Figure 1:
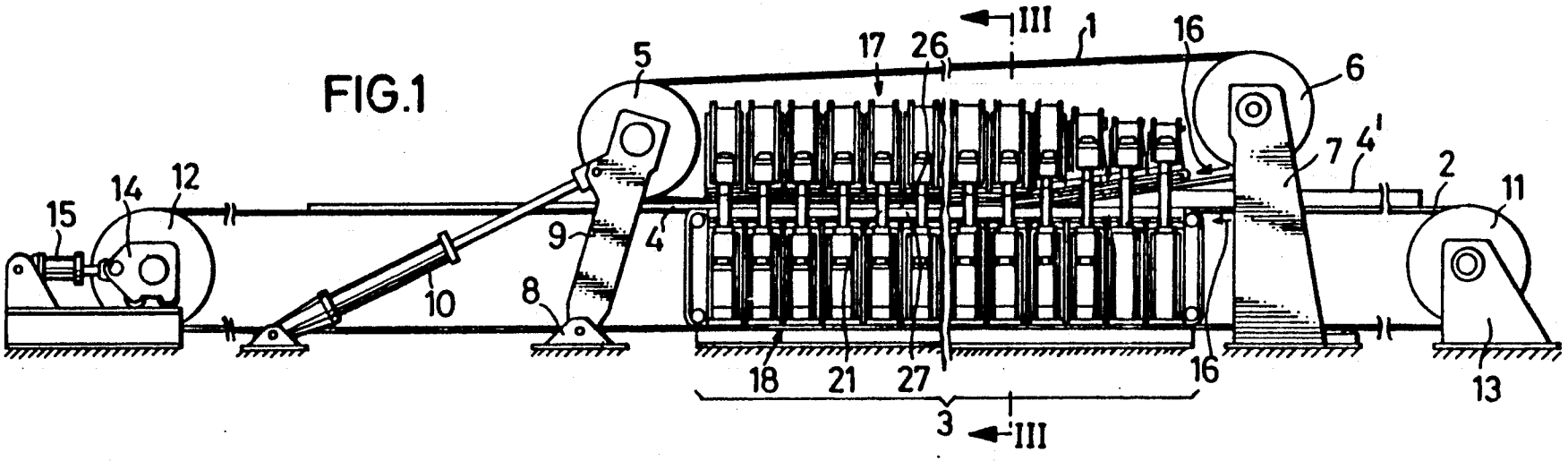
FIG. 1 is a side view of a double belt press on which the present invention can be used.

FIG. 1 shows a double belt press for the production of particle boards, wood fiber boards and other board-shaped materials which consist of particles bonded by means of a binder that hardens under the effect of pressure and heat. The press includes an upper molding belt 1 made of a steel sheet with a thickness of approximately 1 to 1.5 mm, and a similar lower molding belt 2. Between the steel belts 1 and 2, a strip 4 of a bulk material 4', which consists of a material which can be dumped, is compressed in a pressing segment 3, which after the pressing produces one of the aforementioned materials.

The upper steel belt 1 runs around rollers or drums 5 and 6 arranged perpendicular to the strip 4. The drum 6 is mounted in a fixed stand 7, while the drum 5 is mounted in a stand 9 which can pivot around an axis that is perpendicular to the strip 4. The stand 9 pivots about a bearing 8 positioned on the floor. The stand 9 is moved via hydraulic cylinders, and the steel belt 1 is tightened in this manner.

Similar to the belt the steel belt 2 extends around drums 11 and 12 arranged perpendicular to the strip 4. The drum 11 is mounted in a fixed stand 13, while the drum 12 is mounted in a mobile stand 14 that is movable on rails. The stand 14 can be moved in the longitudinal direction (defined by the longitudinal axis of the strip) via hydraulic cylinders 15, and the steel belt 2 can be tightened in this manner. The steel belts 1 and 2 are driven via the drums 5, 6, 11 and 12.

The steel belts 1 and 2 run through the device in the direction indicated by the arrows 16 and thus the bulk material 4' applied to the right side of the apparatus as seen in FIG. 1 is drawn into the pressing segment 3. The outgoing compressed strip 4 is removed from the left region of the steel belt 2 as seen in FIG. 1 by means of any suitable device, which is not shown. In the pressing segment 3, an upper support construction 17 is provided in the inner region of the steel belt 1, which cooperates with a lower support construction 18. The support constructions 17 and 18 support the regions of the steel belts 1, 2 which face the strip 4 and press them together flat with a great force.

The support constructions 17 and 18 are each formed from individual beams 19 and 20, which are each arranged opposite one another above and below, respectively, the steel belts 1 and 2 and the strip 4 (see FIG. 2). Each pair of beams 19 and 20 is clamped in place with side spindles 21 (see FIG. 3), so that individual pressure elements, with the force contained in the unit, are formed.

Disposed between the beams 19, 20 and the steel belts 1, 2, are thick plates 26, 27, which transfer the force exerted by the individual beams 19, 20 evenly over the surface of the steel belts 1, 2. The plates 26 and 27 contain channels 40 (see FIG. 4) in which heating elements are arranged or through which a heating medium is passed.

Roller chains 30 are arranged between the sides of the plates 26, 27 facing each other and the steel belts 1, 2. The steel belts 1, 2 roll on the roller chains 30 relative to the plates 26, 27. The steel belts 1, 2 run around the plates 26, 27 in a continuous manner, forming a loop in a vertical longitudinal plane. The rollers of the roller chains 30 transfer both the pressure and the heat of the plates 26, 27 to the steel belts 1, 2, and thus to the strip 4 that is being formed.

Figure 2:
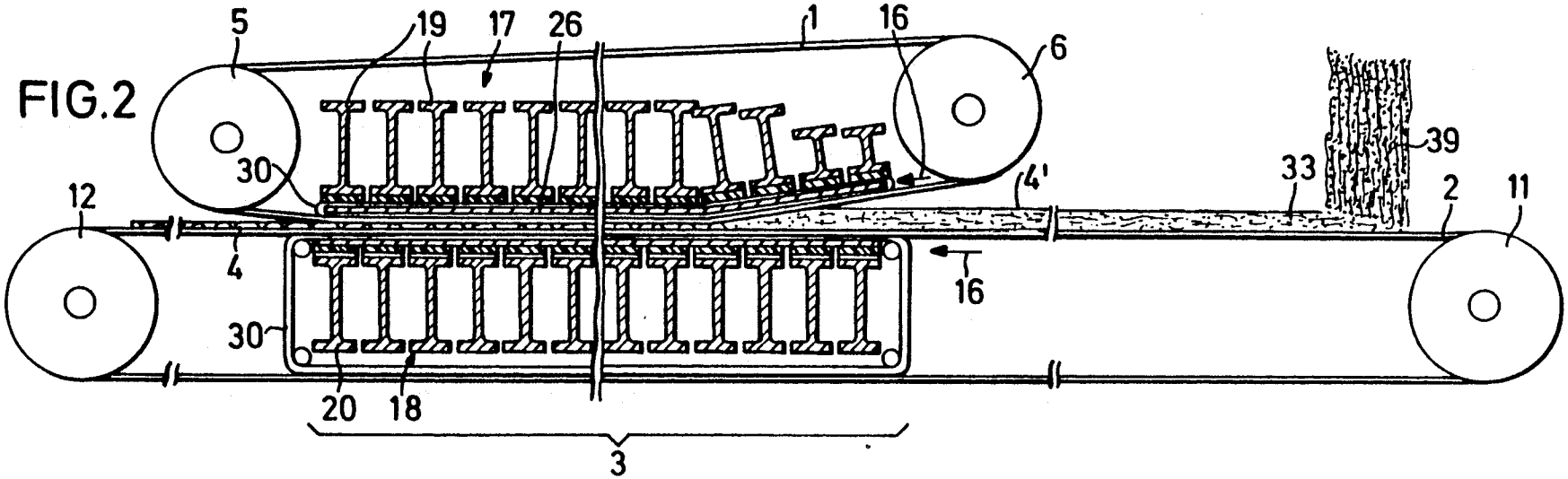
FIG. 2 is a vertical longitudinal cross-section through the double belt press taken along line II—II in FIG. 3.
Figure 3:
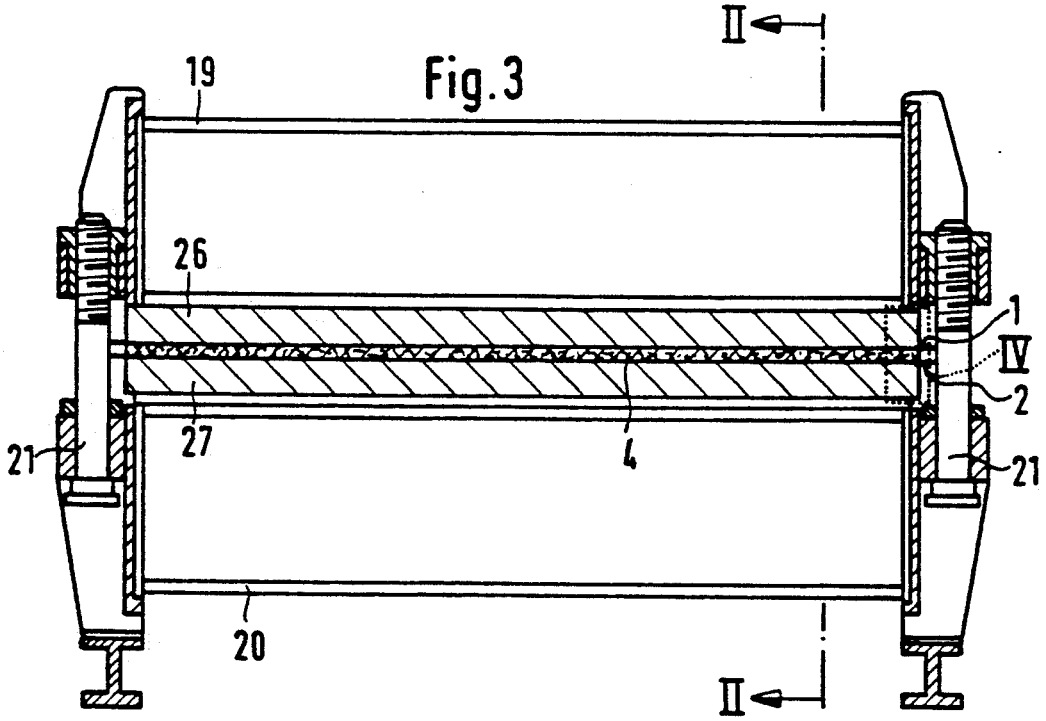
FIG. 3 is a cross-section through the double belt press taken along the line III—III in FIG. 1.
Figure 4:
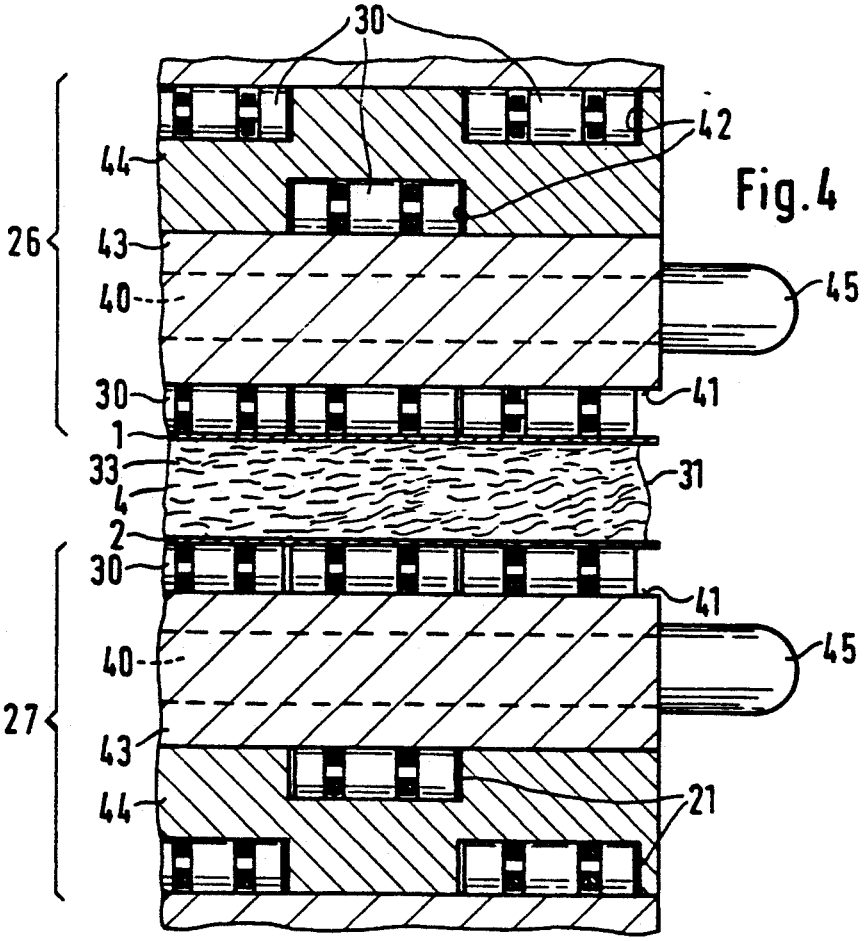
FIG. 4 ,is a partial cross-section through the edge area IV seen within the dotted border in FIG. 3, on an enlarged scale.

The roller chains 30 may return to the actual pressing region, i.e. between the beams 19, 20 and the plates 26, 27, after the chains pass a certain point at the end of the segment 3, which as indicated in FIGS. 2 and 4 is at the plate 26. An advantage of this embodiment is that the roller chains 30 essentially maintain the same temperature during their course of travel. However, it is also possible to pass the roller chains 30 around the outside of the support construction, as can be seen in the bottom of FIG. 2, where the roller chains pass outside the support construction 18.

According to FIG. 4, the plates 26, 27 are composed of a heating and support plate 43 and a separate return plate 44 with return grooves 42 for the roller chains 30. FIG. 4 is a partial cross-section through an edge region located above the strip 4 seen in to FIG. 2.

Figure 5:
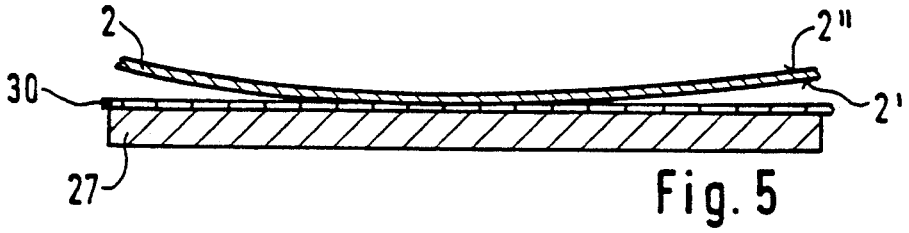
FIG. 5 shows a cross-section through the lower steel belt 2 according to FIG. 3, with the bowl-shaped deformation which occurs after a certain period of operation.

The plates 43 contain the channels 40, which are connected together via pipe bends 45 to form a continuous conduction path. The plates 43 also contain smooth contact surfaces 41, which form the common rolling surfaces for the roller chains 30 arranged next to one another, as is evident in FIG. 5.

When the steel belts I, 2 move forward, the roller chains 30 roll between them and the contact surfaces 41 of the plates 43 which face one another. Adjacent roller chains 30 are directly opposite one another with their outer frontal surfaces.

It is essential to note that in the chain arrangement each of two adjacent roller chains 30 can be moved forward independently of one another. The totality of the support elements of the steel belts 1, 2 form a field which is divided into individual parts in the longitudinal direction, which can shift relative to one another with corresponding stress in the longitudinal direction. Therefore, no constraining forces can develop within the roller chain arrangement as the result of different transport by the molding belts.

In the example of FIG. 2, the lower steel belt 2 is longer than the upper steel belt 1, so that it projects longitudinally beyond the upper belt 1 on the right side, as viewed in FIG. 2. Therefore, a dispersion device (not shown) can be made accessible to this projecting region by arranging it above the top side of the steel belt 2. A layer 33 of wood chips or any other particles that may be used is applied to the steel belt 2 in a dispersion region 39 by the dispersion device, and the layer enters the pressing segment 3 in the direction of the arrow 16. The outer edge 31 of the bulk material 33 compressed to form the strip 4 lies within the edges of the steel belts 1, 2, as is evident from FIG. 4. In the pressing segment 3, the strip 4 exerts significant pressure against the steel belts 1, 2, which is caught by the roller chains 30 and passed on to the contact surfaces 41.

After the press has been in operation for a certain period of time, it turns out that the top side of the lower steel belt 2 in particular, has a bowl-shaped deformation in its cross-section in the force-free state, i.e. in the zone of the steel belt 2 projecting to the right according to FIG. 2, in which the dispersion region 39 is located, even when cold or at uniform temperature. It must be understood that if a bulk material which must be transported further in an unsolidified state is applied to such a curved surface, uneven areas cannot be avoided.

Figure 6:
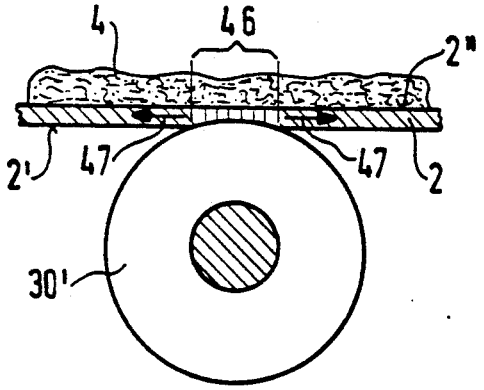
FIG. 6 shows the effect of a single roller and the occurrence of the inherent compressive stress.
Figure 7:
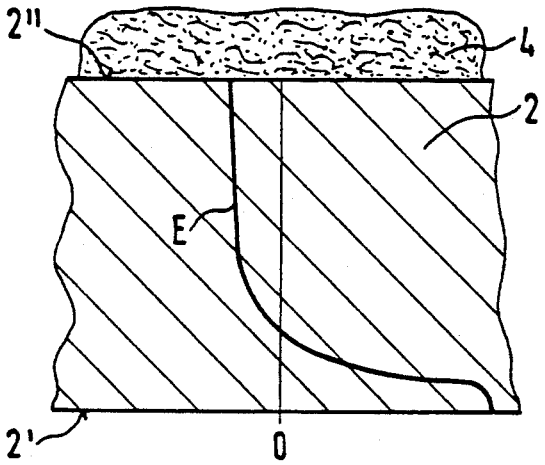
FIG. 7 shows a cross-section through a steel belt in the direction of its width with the inherent stress profile superimposed.

The occurrence of the bowl-shaped deformation of the steel belt 2 is explained with the aid of FIGS. 6 and 7. FIG. 6 shows a single roller 30' of a roller chain 30, on which the steel belt 2 rests and against which the steel belt 2 is pressed from above, under great pressure from the strip 4. In the contact area 46, which is exaggerated in the Figure, the steel belt 2 is elastically compressed, with material being displaced in the direction of the arrows 47. Locally, the elasticity limit may even be exceeded in the essentially linear zone 46, particularly in the center in an area around hard joint sites, giving rise to local plastic deformation. Such deformation processes are repeated when new rollers 30' constantly roll over one and the same site, so that over a certain period of operating time, an inherent stress state E develops, which is plotted in FIG. 7 over the thickness of the steel belt 2. On the side 2' of the steel belt 2 which faces the rollers 30', constant compression occurs, with the formation of compressive stress, countered by tension stresses in a region adjacent to the side 2' facing the bulk material 4, due to equilibrium. The stress distribution results in the steel belt 2 being more or less pressed apart at the "bottom" 2', in the manner evident from FIG. 5, so that a bowl-shaped deformation occurs as soon as the steel belt is left in its own inherent stressed state, without being influenced by outside forces.

Figure 8:
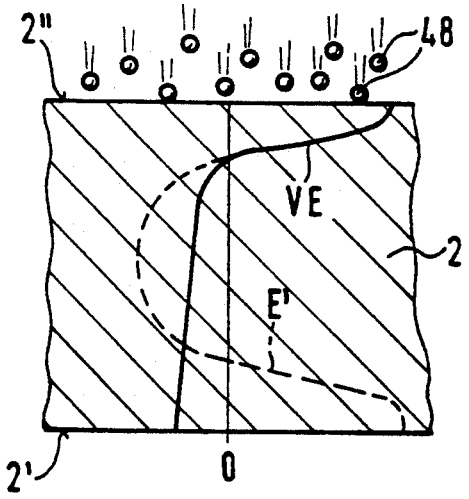
FIG. 8 shows a cross-section corresponding to that shown in FIG. 7 after a one-sided pretreatment according to the method of the present invention.

In order to avoid this phenomenon, the steel belt 2 is subjected to surface treatment by shot blasting before it is installed in the double belt press. In FIG. 8, a first embodiment is shown, in which the treatment is undertaken only on the "top" 2" of the steel belt 2 (i.e., the side of the steel belt 2 nearest the bulk material 4), which faces away from the rollers 30' in the installed state. The steel balls 48 are shot against the surface on the side 2" in an air stream, at high speed, and exert a similar local compression effect on the steel belt 2 upon impact as the roller 30' exerts on the opposite side 2' in the situation illustrated in FIG. 6. After treatment for a certain period of time by means of the shot blasting indicated in FIG. 8, an inherent stress state VE occurs, which is illustrated by solid lines in FIG. 8, and which approximately corresponds to a mirror image of the inherent stress state E shown in FIG. 7. Of course, this artificially induced inherent stress state which is brought about before installation of the steel belt 2 in the double belt press results in the steel belt 2 having a tendency to bend in the opposite direction relative to the bending shown in FIG. 5.

If the steel belt 2 has then been installed and operated with continuous roller movement over the side 2' by the rollers 30', there are also inherent compressive stresses according to FIG. 7 in the vicinity of the sides 2'. An inherent stress state E according to FIG. 7 is therefore superimposed on the artificially induced inherent stress progression VE according to FIG. 8, produced previously, so that finally, the inherent stress state E' shown with a broken line in FIG. 8 is produced. The stress state E' is essentially symmetrical about the center plane of the steel belt 2, and thus does not lead to any bending of the steel belt 2. Since, due to the properties of the steel, the formation of inherent compressive stress does not constantly continue as the rollers 30' roll over the surface, but rather comes to a stop after a certain deformation has been produced, the symmetrical inherent stress state E' is maintained even during further operation of the steel belt 2 in the double belt press.

Figure 9:
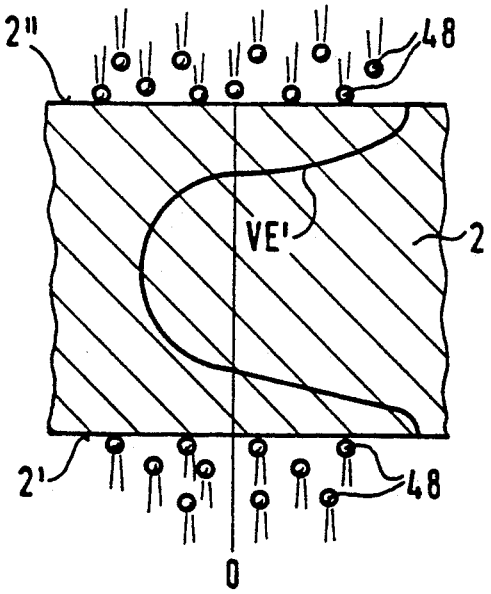
FIG. 9 shows a cross-section corresponding to that shown in FIG. 7 after a pretreatment on both sides according to the method of the present invention.

In the embodiment of the invention shown in FIG. 9, treatment with shot blasting is undertaken on both sides 2' and 2" of the steel belt 2 before its installed in the double belt press, where the impacting steel balls 48 produce surface compacting with inherent pressure stress close to the surface, so that after a certain period of treatment, an inherent stress state VE' occurs. The steel belt 2 is installed in the double belt press with this inherent stress state produced by the preliminary treatment, and this inherent stress state does not significantly change during subsequent startup of the double belt press because the inherent stresses no longer form after the steel has been subjected to continued stress for a period of time, due to the properties of the steel, particularly because the steel surface solidifies and thus the elasticity limit is no longer locally exceeded by the balls 48 or the rollers 30. In this second embodiment of the invention, the steel belt 2 also remains flat during its operation.

A typical steel which may be used to form the steel belts 1, 2 has, for example, the following alloy components:

| | |
|---|---|
| C | <0.09 |
| Cr | 15.0 |
| Ni | 7.0 |
| Cu | 0.7 |
| Ti | 0.5 |

(in % by weight)

What is claimed is:

1. A method for treating steel belts of a double belt press that exert pressure on a continuous strip for producing materials such as particle board by passing the strip between the steel belts that form continuous loops such that the steel belts extend over the width of the strip and which convey the strip in a forward direction, the double belt press also including rollers rotatable in a longitudinal plane extending perpendicular to the continuous strip, and a support construction forming pressure transfer elements that transfer the working pressure from the support construction to the steel belts, the rollers being disposed between the steel belts and the support construction, said method comprising the step of surface treating at least the lower steel belt on at least a side thereof facing away from the rollers, whereby inherent compressive stress is provided in a region close to the surface of the lower steel belt facing away from the rollers, said surface treating step being performed before the lower steel belt is installed in the double belt press.

2. The method of claim 1 wherein the support construction further comprises heat transfer elements that transfer heat to the edges of the steel belts to produce a uniform temperature across the steel belts.

3. The method of claim wherein the surface treating step comprises shot blasting.

4. The method of claim 2 wherein the surface treating step comprises shot blasting.

* * * * *

UNITED STATES PATENT AND TRADEMARK OFFICE

CERTIFICATE OF CORRECTION

PATENT NO. : 5,224,367

DATED : July 6, 1993

INVENTOR(S) : Ahrweiler et al.

It is certified that error appears in the above-indentified patent and that said Letters Patent is hereby corrected as shown below:

Column 4 line 12, after "belt" first occurrence insert --1,--.

Signed and Sealed this

Thirty-first Day of May, 1994

Bruce Lehman

BRUCE LEHMAN

*Commissioner of Patents and Trademarks*

*Attest:*

*Attesting Officer*